United States Patent [19]

Inoue et al.

[11] 4,433,271

[45] Feb. 21, 1984

[54] HIGH PRESSURE DISCHARGE LAMP

[75] Inventors: Akihiro Inoue, Chigasaki; Akihiro Kamiya, Yokosuka, both of Japan

[73] Assignee: Tokyo Shibaura Denki Kabushiki Kaisha, Kawasaki, Japan

[21] Appl. No.: 264,408

[22] Filed: May 18, 1981

[30] Foreign Application Priority Data

Jul. 15, 1980 [JP] Japan ..... 55-99852[U]

[51] Int. Cl.[3] ..... H01J 17/34; H05B 41/08

[52] U.S. Cl. ..... 315/63; 315/73; 315/56; 315/335; 313/601; 313/47; 313/239

[58] Field of Search ..... 315/46, 47, 52, 56, 315/63, 73, 335; 313/340, 356, 239, 198, 17, 47, 601

[56] References Cited

U.S. PATENT DOCUMENTS

| | | | |
|---|---|---|---|
| 2,799,793 | 7/1957 | DeCain | 313/17 |
| 2,859,383 | 11/1958 | Woods et al. | 313/239 X |
| 4,117,370 | 9/1978 | Jacobs et al. . | |
| 4,144,475 | 3/1979 | Delen et al. | 315/73 |
| 4,328,445 | 5/1982 | Van Den Plas et al. | 315/46 |

FOREIGN PATENT DOCUMENTS

| | | | |
|---|---|---|---|
| 55-59651 | 5/1980 | Japan | 315/73 |

*Primary Examiner*—Eugene R. LaRoche
*Assistant Examiner*—Vincent DeLuca
*Attorney, Agent, or Firm*—Oblon, Fisher, Spivak, McClelland & Maier

[57] ABSTRACT

A high pressure discharge lamp including discharge tube having at least two electrodes at opposite ends thereof, an outer bulb housing the discharge tube, a circuit for starting the discharge tube and a glow starter which is covered with a heat shield member and disposed between the discharge tube and the outer bulb.

5 Claims, 3 Drawing Figures

HIGH PRESSURE DISCHARGE LAMP

BACKGROUND OF THE INVENTION

1. Field of the Invention

This invention relates generally to a high pressure discharge lamp employing a glow starter.

2. Description of the Prior Art

A high pressure discharge lamp such as metal-halide lamp and a high pressure sodium lamp have been used for their high output and high lighting efficiency. But presently such lamps need a special starting means because they have a high starting voltage.

So a high pressure discharge lamp using a glow starter having a glass body as a starting means has been developed. For example, U.S. Pat. Nos. 4,117,370 and 4,144,475 disclose using a glow starter as a starting means.

But the above mentioned glow starter is used as it is, i.e. without a covering for the body of the glow starter. Consequently, such a glow starter is apt to be deformed on account of heat radiation of the discharge tube for long periods of continuous lighting. A disadvantage of the conventional glow starter is its short life on account of impurity gases released therein as produced by heat radiation from the discharge tube. Moreover, the glow starter is mounted by means of welding of its leadwires to a support structure, so it may be damaged occasionally by a spark during welding. Further, since the glow starter is mounted solely by the welding of the leadwires, it is highly susceptible to damage from vibration or shock of the lamp.

A further problem attendant to the conventional lamp is related to the fact that the glow starter is fixed near the end of an outer bulb, and at times it is deformed by heat radiation of a gas burner during sealing of the outer envelope to the lamp stem member.

SUMMARY OF THE INVENTION

Accordingly, one object of this invention is to provide a novel high pressure discharge lamp exhibiting decreased heat radiation from a discharge tube to a glow starter.

Another object of this invention is to provide a novel high pressure discharge lamp having a rigidly mounted glow starter.

Yet another object of this invention is to provide a novel high pressure discharge lamp having a glow starter which is protected from heat during manufacturing.

These and other objects have now been attained according to this invention by providing a high pressure discharge lamp in which a glow starter is covered and mounted by means of a heat shield member.

BRIEF DESCRIPTION OF THE DRAWING

A more complete appreciation of the invention and many of attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
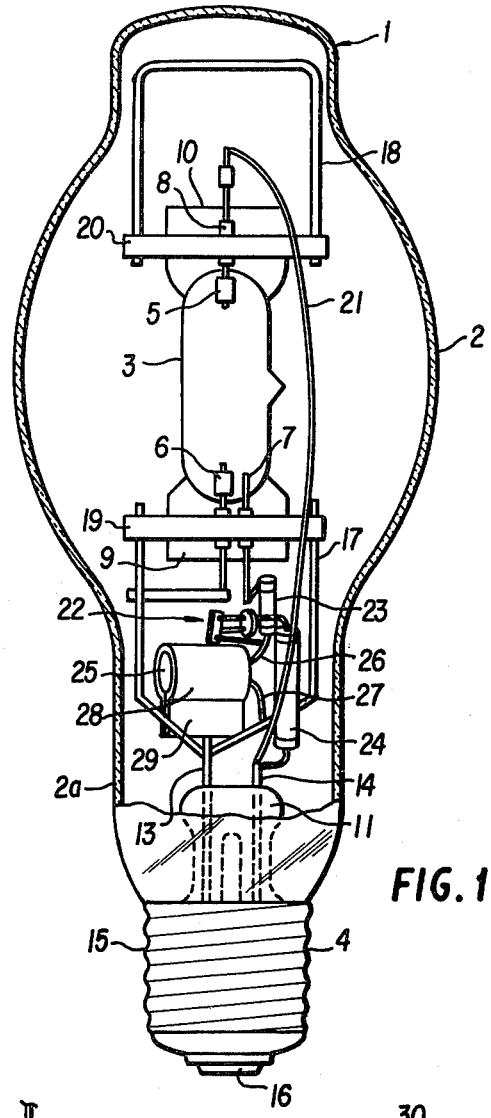
FIG. 1 is a longitudinal cross-sectional partly elevational view of a high pressure discharge lamp of this invention.
Figure 2:
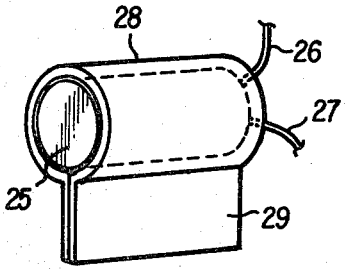
FIG. 2 is a perspective view of a heat shield member according to this invention.

Referring now to the drawings, wherein like reference numerals designate identical or corresponding parts through the several views, and more particularly to FIG. 1 and FIG. 2 thereof, a metal-halide lamp 1 comprises a vitreous outer bulb 2 and a discharge tube, i.e. a quartz arc tube 3, the outer bulb 2 having a screw base 4 at one end thereof. the arc tube 3 contains a quantity of mercury which is substantially completely vaporized and exerts a pressure from 1 to 10 atmospheres in operation, a quantity of sodium iodide and scandium iodide. An inert rare gas under pressure, for instance argon at a pressure of 25 torr, is included in the arc tube 3 to facilitate starting and warm-up. A part of main electrodes 5,6, is employed at the end of each of the arc tube 3 and a starting electrode 7 is provided near the main electrode 6. The electrodes 5, 6, are supported on leads which include thin molybdenum foil sections 8 extending through respective pinch sealed ends 9, 10, of the arc tube 3. Main electrodes 5, 6, each include a tungsten wire around which a helix may be wrapped. Activation may be produced by a layer of thorium metal provided on the electrode tip which results from the decomposition of thorium iodide by the discharge. The starter electrode 7 may be a fine tungsten wire having only a tip thereof projecting into the arc tube 3.

The neck **2*a* of the outer tube 2 is closed by a stem 11 through which extend stiff lead wires 13, 14 which are respectively connected at their outer ends to the screw shell 15 and to the center contact 16 of base 4**.

The pinch sealed parts of the arc tube 3 are fixed to support structure 17, 18 by way of metal holders 19, 20. The support structure 17 is connected to the lead wires 13 by welding. The main electrode 6 is connected to the support structure 17 and the other main electrode 5 is connected to the lead wire 14 by way of a lead wire 21. The starting electrode 7 is connected to a bimetal switch 22 adapted to close at a normal temperature and to open above a predetermined temperature, by way of a starting resistor 23. The bimetal switch 22 is connected to the lead wire 14 by way of a current limiting resistor 24. Reference numeral 25 refers to a glow starter having a glass body and one lead wire 26 thereof connected to the starting resistor 23 and the other lead wire 27 connected to the support structure 17.

The glow starter 25 is covered with a heat shield member 28. As is shown in FIG. 2, the heat shield member 28 is made of a metal plate, such as stainless steel, aluminum, or nickel, and surrounds substantially the entire side wall of the glow starter 25. Namely the heat shield member 28 consists of one thin rectanglar plate, i.e. about 25 millimeter by 48 and 0.15 millimeter thick. The member 28 includes a fixing part 29 which is mounted to the support structure 17 by welding.

Figure 3:
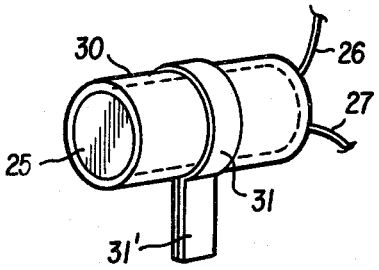
FIG. 3 is a perspective view of another embodiment of the heat shield member of this invention.

FIG. 3 shows another embodiment of this invention. The heat shield member 30 is made of an insulating cover member 30, such as glass wool or mica. The heat shield member 30 surrounds at least the side wall of the glow starter 25 and a fixing member 31 made of a metal such as stainless steel surrounds the heat shield member 30. The end part 31 of the fixing member 31 is firmly mounted to the support structure 17 by welding.

In such a construction of a metal-halide discharge lamp 1 having a glow starter 25 which is provided with a heat shield member 28 or especially the heat insulating heat shield member 30, the glow starter 25 is minimally influenced by heat from the arc tube 3 on account of the heat shield member 28 or 30. Consequently, there is no deformation of the glow starter 25 and no release of impurity gases within the glow starter 25.

Moreover, during sealing of the neck 2*a* of the outer tube 2 and the stem 11, the glow starter 25 is little influenced by heat radiation from a gas burner used for sealing.

Furthermore, the glow starter 25 is fixed to the support structure 17 by way of the fixing part 29 of the heat shield member 28 or the fixing member 31 shown in FIG. 3. So the glow starter if firmly mounted and able to withstand shock and vibration.

Obviously, numerous modifications and variations of this invention are possible in light of the above teachings. It is therefore to be understood that within the scope of the appended claims, the invention may be practiced otherwise than as specifically described herein.

What is claimed as new and desired to be secured by Letters Patent of the United States is:

1. A high pressure discharge lamp comprising;

a discharge tube having a main electrode at each end thereof;

an outer bulb housing said discharge tube;

a circuit for starting said discharge tubes; and a glow starter covered with a heat shield member and disposed between said discharge tube and said outer bulb wherein said heat shield member comprises a heat insulating covering member wrapped around a major portion of the surface area of said glow starter and a mounting member engaging said covering member whereby said glow starter is subject to decreased heat radiation from said discharge tube and whereby said glow starter is protected from heat during the manufacturing of said lamp.

2. The high pressure discharge lamp of claim 1, wherein at least one of said covering member and said mounting member is made of metal plate.

3. The high pressure discharge lamp of claim 2, wherein said heat shield member is mounted directly to a support structure.

4. The high pressure discharge lamp of claim 1, further comprising:

a support member for supporting said discharge tube; and said mounting member made of metal and mounted directly on said support member.

5. The high pressure discharge lamp of claim 1 wherein said covering member consists of a material selected from the group consisting of glass wool and mica.

* * * * *